US006946614B2

(12) United States Patent
McKean et al.

(10) Patent No.: US 6,946,614 B2
(45) Date of Patent: Sep. 20, 2005

(54) CIRCUIT BREAKERS

(75) Inventors: Brian McKean, Ruddington (GB); Nigel Timothy McKean, Ruddington (GB); Brian Andrew Richard McKean, Ruddington (GB)

(73) Assignee: Brian McKean Associates, Ltd. (GB)

( * ) Notice: Subject to any disclaimer, the term of this patent is extended or adjusted under 35 U.S.C. 154(b) by 0 days.

(21) Appl. No.: 10/380,292

(22) PCT Filed: Sep. 13, 2001

(86) PCT No.: PCT/GB01/04103

§ 371 (c)(1),
(2), (4) Date: Sep. 17, 2003

(87) PCT Pub. No.: WO02/23687

PCT Pub. Date: Mar. 21, 2002

(65) Prior Publication Data

US 2004/0050820 A1 Mar. 18, 2004

(30) Foreign Application Priority Data

Sep. 13, 2000 (WO) ..... PCT/GB00/03516

(51) Int. Cl.[7] ..... H01H 33/66
(52) U.S. Cl. ..... 218/154; 218/7; 218/120

(58) Field of Search ..... 218/118, 120, 218/121, 139, 140, 134, 138, 153–155, 10, 14, 78, 79, 84

(56) References Cited

U.S. PATENT DOCUMENTS

| | | | | |
|---|---|---|---|---|
| 3,562,457 A | | 2/1971 | Peek | |
| 5,191,180 A | * | 3/1993 | Kitamura et al. | 218/135 |
| 5,350,892 A | * | 9/1994 | Rozier | 218/119 |
| 5,585,611 A | | 12/1996 | Harvey et al. | |
| 5,729,888 A | | 3/1998 | Abdelgawad et al. | |

* cited by examiner

*Primary Examiner*—Elvin Enad
*Assistant Examiner*—M. Fishman
(74) *Attorney, Agent, or Firm*—Fleit Kain Gibbons Gutman Bogini Bianco; Paul D. Bianco; Martin Fleit

(57) ABSTRACT

A circuit breaker includes an interrupter coaxial with a current sensor or transformer, the combined assembly being encapsulated within solid dielectric material and supported by an earthed tube mounted on an earthed housing. Detection by the sensor of a current overload is communicated over conductors to a circuit within the housing to cause an actuator to pull a dielectric linkage in a direction so as to move an armature through a bell crank and open interrupter, thereby opening the main current path between conductors and flexible coupling. The circuit breaker requires no insulating gas or oil.

4 Claims, 3 Drawing Sheets

CIRCUIT BREAKERS

This application is a U.S. National Phase Application under 35 U.S.C. §371 of International Application No. PCT/GB01/04103 (published in English) filed Sep. 13, 2001.

FIELD OF THE INVENTION

The present invention is concerned with circuit breakers, particularly of the type comprising current sensing devices or current transformers to detect primary current overloads or short-circuits for monitoring and protection.

BACKGROUND

Circuit breakers at medium voltages usually need to employ current sensing devices or transformers to detect primary current overloads and short-circuits for monitoring and protection. In indoor applications, these may be incorporated in the equipment of which the circuit breaker is a component part On the other hand, in outdoor applications, particularly in rural electrification schemes, where the circuit breaker is often used in overhead line applications, the current sensor or transformer is preferably incorporated as an integral part of the circuit breaker.

This is usually achieved by mounting a current sensor, such as a ring-type current sensor or transformer, coaxial with an insulated conductor or bushing. Typical examples of conventional use are shown in FIGS. 1 and 2. The interrupting device could be typically a vacuum or gas switch.

The design in FIG. 1 usually requires some form of additional liquid or gaseous insulation, such as oil or SF6, to keep the size of the circuit breaker to acceptable levels and also to ensure that the internal components are maintained free of moisture and contamination. A more recent design is depicted generally in FIG. 2. Here, the need for a tank filled with oil or SF6 is removed. The current transformer or sensor is mounted at the side of the switch and electrically in series with it. This example uses a vacuum switch and current transformer encapsulated in solid insulation.

In both cases, however, it is still necessary for the insulation exposed to outside environmental conditions to have additional "creepage" length compared to insulation that is protected from the external environment. Thus, although the typical design illustrated in FIG. 2 does not need liquid or gaseous insulation material to minimise the overall dimensions, it is still necessary to protect the internal surface 1 of the insulation below the switch from the effects of condensation. In exposed hostile environments, this can only be done in a practical manner by filling the volume below the switch with a controlled environment such as dry nitrogen or SF6. This requires additional seals and monitoring and regular maintenance to ensure that the internal surface does not become contaminated. It is vitally important to ensure that the internal surface is kept clean and free from condensation and contamination, otherwise there is a risk of internal electrical discharge from the live conductor down the insulation to earth.

In FIG. 1, the current flowing through the device is carried by conductors 1, encapsulated in suitable electrically insulating material 2, such as epoxy resin or polymer concrete. Connection 9, flexible connection 4 and switch 7 provide the internal conducting path. Operation to open or close the switch 7 is performed by actuator 8 and lever 5. The integrity of the internal insulation surfaces is maintained by using SF6 gas or oil.

In FIG. 2, the current flowing through the device is similarly carried by conductors 21 and switch 22 through current transformer 23. In order to maintain the integrity of internal surface 24, some form of controlled environment is required, such as SF6 gas or dry nitrogen. Thus, in both cases it is necessary to protect the internal insulation surfaces by using a controlled environment, leading to additional costs and also risks of degradation and failure if the controlled environment is dissipated due to failure of seals and leakage.

SUMMARY OF THE INVENTION

Accordingly, the invention aims to provide a circuit breaker that does not suffer from the above disadvantages. To that end, the invention provides a circuit breaker comprising an assembly consisting of a circuit interrupter mounted coaxially within a current sensor or transformer, said assembly being encapsulated within solid dielectric material and supported at one end of an earthed electrically conductive tube whose other end is mounted on an earthed metal housing.

The circuit breaker is preferably a vacuum interrupter.

The circuit breaker is conveniently operated by means of a mechanical linkage of insulating material extending between said interrupter and an actuator, said linkage being mounted externally of the metal tube and said solid dielectric material.

The operating mechanism for the circuit interrupter may be selected from any of the group consisting of a permanent magnet actuator, a spring-type actuator, a hydraulic actuator, a pneumatic actuator or a solenoid actuator.

The mechanical linkage preferably comprises a rod of solid dielectric material. The ends of the rod preferably pass through flexible bellows, at one end into a space within the dielectric material encapsulating the circuit interrupter/current sensor or transformer assembly, and at the other end into the said earthed housing.

BRIEF DESCRIPTION OF THE FIGURES

The invention will be described with reference to the following drawings, in which.

DETAILED DESCRIPTION OF THE ILLUSTRATED EMBODIMENTS

Figure 1:
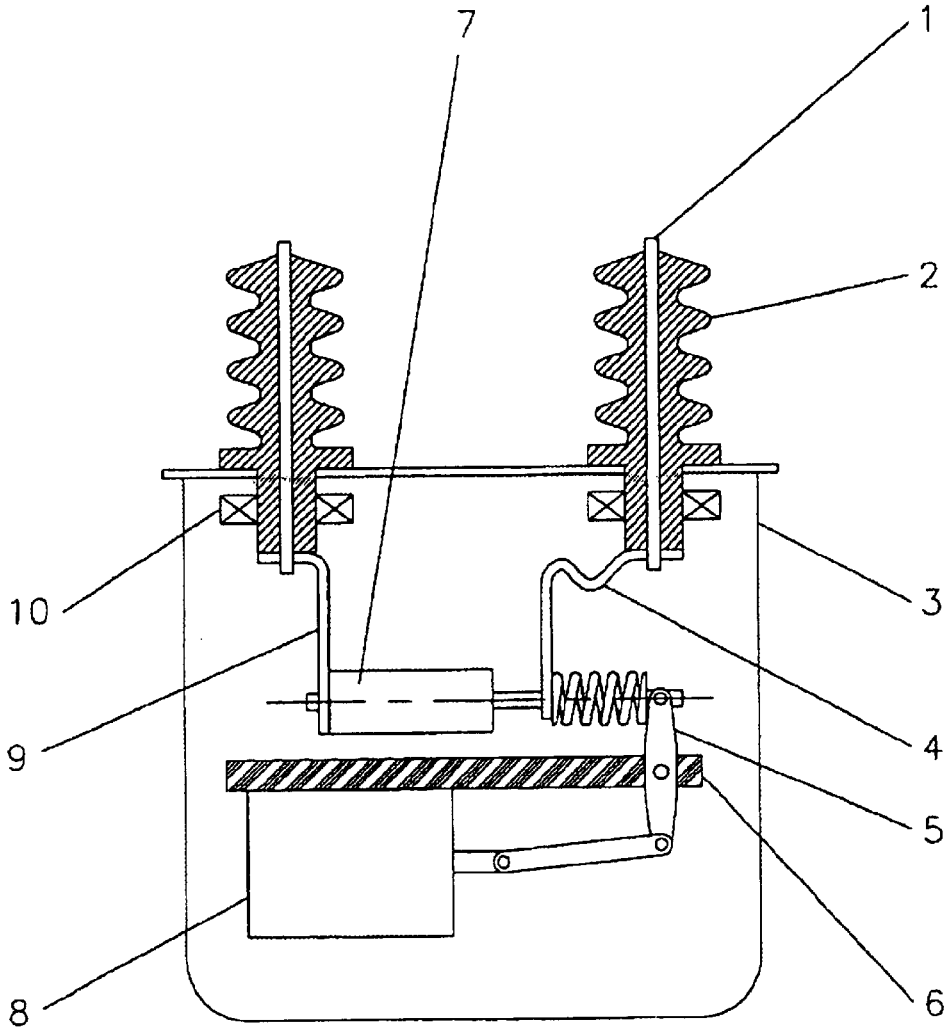
FIG. 1 (PRIOR ART)
FIG. 1 is a typical prior art circuit breaker.
Figure 2:
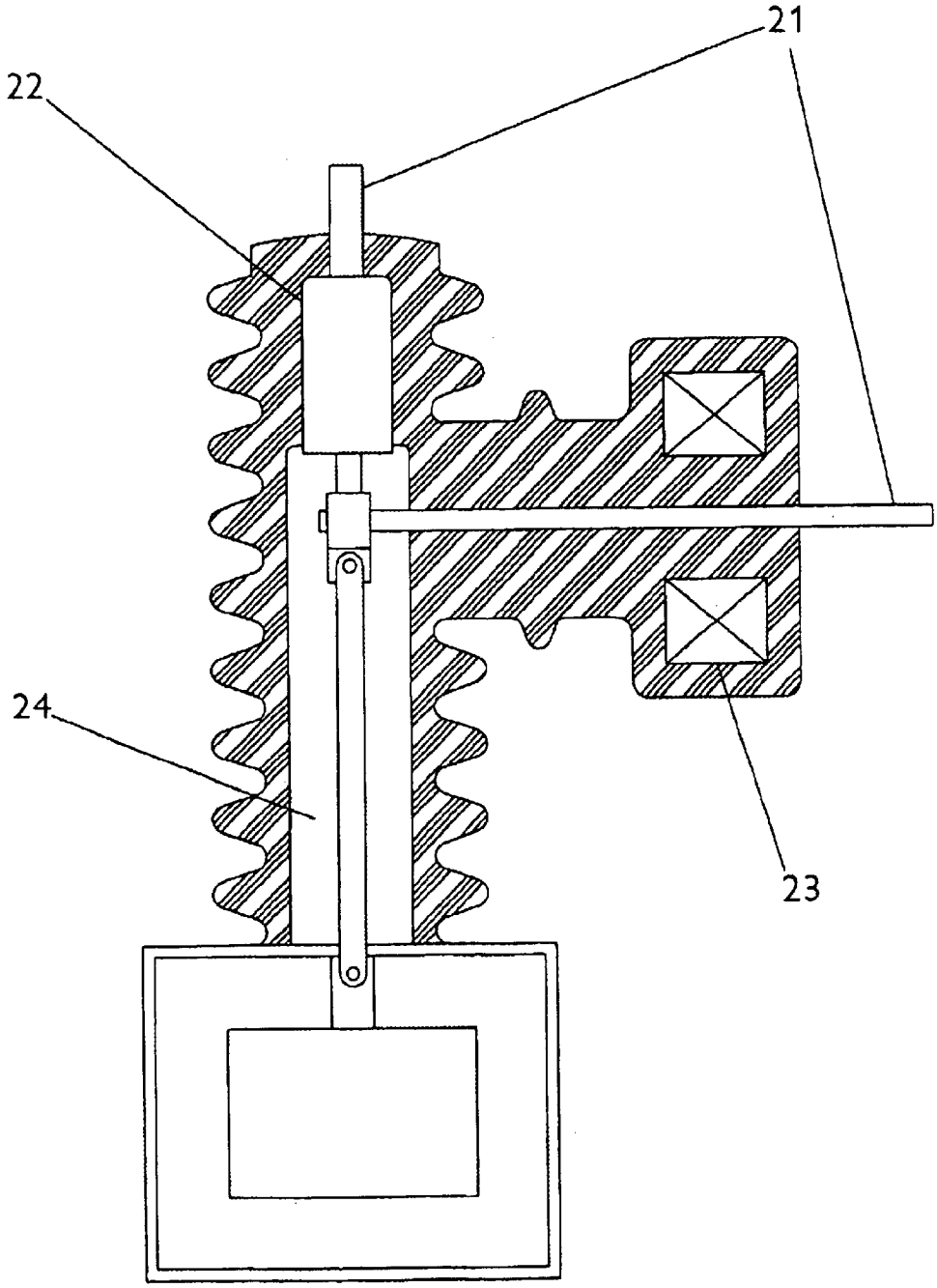
FIG. 2 (PRIOR ART)
FIG. 2 is a later development of a prior art circuit breaker.
Figure 3:
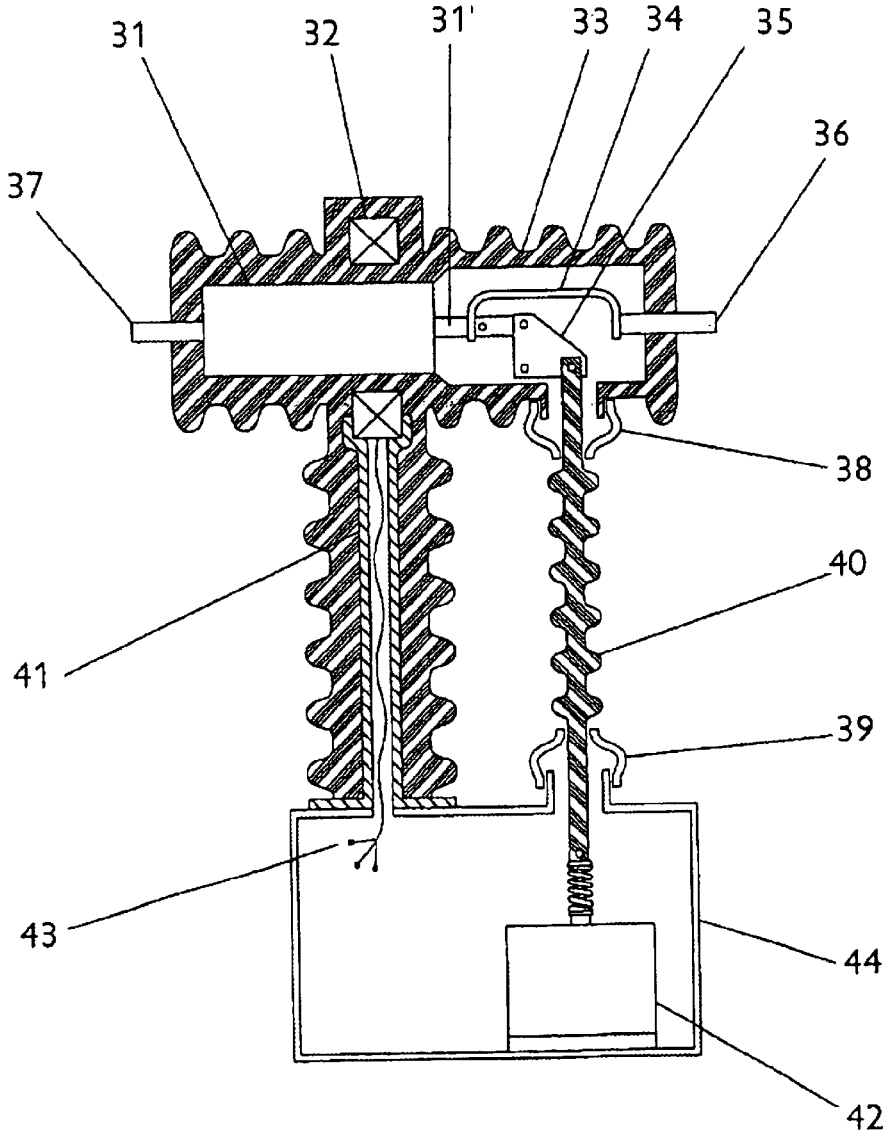
FIG. 3 is an example of a circuit breaker in accordance with the present invention.

In general, a solution to the problems discussed above in connection with known circuit breakers is to provide a circuit breaker where the circuit interrupter 31 is mounted coaxially within the current sensor or transformer 32. The combination is encapsulated within the main electrically insulating body 33, as shown in FIG. 3. By encapsulating the interrupter and current sensor or transformer in this way, the secondary winding can be supported by an earthed metal tube 41. There is then no internal insulation exposed to high voltage stress, either between parts at high voltage and earth or across the terminals of the circuit breaker. This removes completely the need for additional protection and regular maintenance.

Referring now in more detail to FIG. 3, an interrupter 31 is connected between conductors 36, 37 constituting the main current path. Coaxially located around the interrupter 32 is a current sensor or transformer 32. The interrupter 31 has an armature 31' connected via a flexible coupling 44 to one of the main current path conductors 36.

Both the interrupter 31 and the current sensor or transformer are encapsulated in a housing 33 of dielectric material. The sensor or transformer 32 is supported at one end of an electrically conductive tubular body 41, eg of metal, whose other end is electrically and mechanically connected to an electrically conductive housing 44. Secondary wires 43 from the current sensor or transformer 32 can be fed through the metal tube 41 to a suitable terminal board (not shown) mounted in the housing 44. The housing 44 and the metal tube 44 are connected to an earth terminal (not shown).

An actuator 42 is located within the housing 44 and is coupled to a linkage 40, preferably comprising a dielectric rod. One end of the rod 40 is coupled to the actuator, for example via a spiral spring, and the other end is coupled to a bell crank mechanism 35. The bell crank mechanism 35 is also coupled to the armature 31' of the interrupter 31.

When the current sensor or transformer 32 senses an overload current, circuitry on the terminal board senses the overload condition and activates the actuator 42 in the housing 44 so as to tend to pull the linkage 40 in direction A. The pull on the link 40 is translated into movement of the bell crank 35 so as to tend to pull the armature 31' of the interrupter 31 in a rightwards direction (in FIG. 3), whereby to open the interrupter 31. In this way, the circuit breaker opens the main current path through conductors 36, 37 in response to detection of the overload current. The interrupter 31 is restored by the action of the actuator 42 pushing the linkage 40 in direction B to close the interrupter 31 via the bell crank lever 35, whereby to close the circuit breaker and restore it to its dormant position.

The linkage 40 is preferably terminated mechanically by flexible bellows 38 and 39 to provide weather protection where the linkage or drive rod 40 enters the housings 33 and 44.

The push-pull motion can be achieved by using a suitable operating mechanism, such as a permanent magnet actuator as described in UK Patent No 2297429 or any other form of suitable actuator 42, such as spring, hydraulic, pneumatic or solenoid types.

What is claimed is:

1. A circuit breaker comprising an assembly consisting of a circuit interrupter between two main current path conductors, the interrupter being encapsulated within solid dielectric material and supported at one end of an earthed electrically conductive elongate support whose other end is mounted on an earthed metal housing, the elongate support also being encapsulated within solid dielectric material, wherein said interrupter is operated by means of a mechanical linkage comprising a rod of solid dielectric material extending between said interrupter and an actuator, said linkage being mounted externally of the conductive elongate support and said encapsulating solid dielectric material, said actuator being selected from the group consisting of a permanent magnet actuator, a spring-type actuator, a hydraulic actuator, a pneumatic actuator, and a solenoid actuator, and wherein the ends of the rod pass through flexible bellows, at one end into a space within the dielectric material encapsulating said interrupter, and at the other end into said earthed housing, whereby no internal insulation is exposed to high voltage stress.

2. A circuit breaker comprising an assembly consisting of a circuit interrupter mounted coaxially within a current sensor or transformer between two main current path conductors, said assembly being encapsulated within solid dielectric material and supported at one end of an earthed electrically conductive elongate tube whose other end is mounted on an earthed metal housing, the electrically conductive elongate tube suppport also being encapsulated within solid dielectric material, wherein said interrupter is operated by means of a mechanical linkage comprising a rod of solid dielectric material extending between said interrupter and an actuator, said linkage being mounted externally of the electrically conductive elongate tube support and said encapsulating solid dielectric material, and wherein the ends of the rod pass through flexible bellows, at one end into a space within the dielectric material encapsulating said interrupter, and at the other end into said earthed housing, whereby no internal insulation is exposed to high voltage stress.

3. A circuit breaker as claimed in claim 1, wherein said interrupter is a vacuum interrupter.

4. A circuit breaker as claimed in claim 2, wherein said actuator is selected from the group consisting of a permanent magnet actuator, a spring-type actuator, a hydraulic actuator, a pneumatic actuator, and a solenoid actuator.

* * * * *